US010465677B2

(12) United States Patent
Saukko et al.

(10) Patent No.: US 10,465,677 B2
(45) Date of Patent: Nov. 5, 2019

(54) CONTROL METHOD FOR COMPRESSOR SYSTEM

(71) Applicant: ABB Schweiz AG, Baden (CH)

(72) Inventors: Juha Saukko, Helsinki (FI); Markku Lyyjynen, Espoo (FI); Jukka Tolvanen, Helsinki (FI)

(73) Assignee: ABB Schweiz AG, Baden (CH)

( * ) Notice: Subject to any disclaimer, the term of this patent is extended or adjusted under 35 U.S.C. 154(b) by 47 days.

(21) Appl. No.: 15/418,242

(22) Filed: Jan. 27, 2017

(65) Prior Publication Data

US 2017/0218964 A1 Aug. 3, 2017

(30) Foreign Application Priority Data

Jan. 28, 2016 (EP) ..... 16153121

(51) Int. Cl.
*F04B 49/20* (2006.01)
*F04B 49/06* (2006.01)
(Continued)

(52) U.S. Cl.
CPC ..... *F04B 49/20* (2013.01); *F04B 35/04* (2013.01); *F04B 41/02* (2013.01); *F04B 49/06* (2013.01);
(Continued)

(58) Field of Classification Search
CPC ..... F04B 49/103; F04B 49/06; F04B 49/065; F04B 49/20; F04B 2203/0208; F04B 2203/0209; F04B 41/02; F04B 35/04; F04B 49/08; F04B 2203/0207; F04C 28/08; F04C 28/28; F04C 14/08; F04C 14/28; F04C 2270/03; F04C 2270/05; F04C 2270/051;
(Continued)

(56) References Cited

U.S. PATENT DOCUMENTS 4,978,896 A * 12/1990 Shah ..... G05D 7/0676 236/DIG. 9
5,019,757 A * 5/1991 Beifus ..... F04D 27/004 318/400.07
(Continued)

FOREIGN PATENT DOCUMENTS

EP 1277959 A2 1/2003
EP 2023480 A2 2/2009

OTHER PUBLICATIONS

European Search Report, EP16153121, ABB Technology Oy, dated Jun. 3, 2016, 6 pages.

*Primary Examiner* — Bryan M Lettman
(74) *Attorney, Agent, or Firm* — Taft Stettinius & Hollister LLP; J. Bruce Schelkopf

(57) ABSTRACT

A control method for a compressor system includes a compressor connected to a pressure vessel and a frequency converter controlling an electric motor of the compressor. In the method, the present operating state is estimated on the basis of a monitored/estimated electrical quantity of the compressor system. The operating state may represent the pressure in the pressure vessel. The pressure in the pressure vessel causes a counter-torque to the motor. The counter-torque is proportional to the pressure and may be used for estimating the pressure inside the pressure vessel. An estimate of a counter-torque may be calculated on the basis of the monitored electrical quantity or quantities.

4 Claims, 1 Drawing Sheet

(51) Int. Cl.

| | |
|---|---|
| ***F04B 49/10*** | (2006.01) |
| ***F04B 35/04*** | (2006.01) |
| ***F04B 41/02*** | (2006.01) |
| ***F04B 49/08*** | (2006.01) |
| ***F04D 27/00*** | (2006.01) |

(52) U.S. Cl.
CPC ..... *F04B 49/065* (2013.01); *F04B 49/08* (2013.01); *F04B 49/103* (2013.01); *F04D 27/001* (2013.01); *F04B 2203/0207* (2013.01); *F04B 2203/0208* (2013.01); *F04B 2203/0209* (2013.01)

(58) Field of Classification Search
CPC ... F04D 27/004; F04D 27/0261; F04D 27/001
See application file for complete search history.

(56) References Cited

U.S. PATENT DOCUMENTS

| | | | | |
|---|---|---|---|---|
| 5,736,823 | A * | 4/1998 | Nordby | G05D 7/0676 318/432 |
| 6,577,089 | B1 | 6/2003 | Piedl et al. | |
| 7,117,120 | B2 * | 10/2006 | Beck | E21B 43/126 702/182 |
| 8,459,053 | B2 * | 6/2013 | Pham | F04B 39/06 62/228.5 |
| 2011/0200454 | A1 * | 8/2011 | Ahonen | F04D 15/0088 417/45 |

* cited by examiner

CONTROL METHOD FOR COMPRESSOR SYSTEM

FIELD OF THE INVENTION

The present invention relates to a control of a compressor and particularly to estimating the operating state of the compressor.

BACKGROUND INFORMATION

Pressure in a pressure vessel of a compressor system may be controlled in various ways. For example, under a load/unload control scheme, a compressor operating at a constant speed is controlled to a load mode or an unload mode in turn. The pressure inside the pressure vessel alternates between a minimum pressure limit and a maximum pressure. Alternatively, a PI control scheme may be used for controlling the compressor. A PI or a PID controller may be used to control a rotational speed of the compressor such that the pressure inside stays at a desired, constant level.

In order to be able to control the pressure inside the pressure vessel, the compressor system may comprise a pressure sensor. Such a sensor may increase the cost of the compressor system. Further, the sensor may be prone to malfunctions and may require regular maintenance.

BRIEF DISCLOSURE

An object of the present invention is to provide a method and an apparatus for implementing the method so as to alleviate the above disadvantages. The objects of the invention are achieved by a method and an arrangement which are characterized by what is stated in the independent claims. The preferred embodiments of the invention are disclosed in the dependent claims.

The present disclosure describes a control method for a compressor system that comprises a compressor connected to a pressure vessel and a frequency converter controlling an electric motor of the compressor. In the method, the present operating state can be estimated on the basis of a monitored/estimated electrical quantity of the compressor system. The operating state may represent the pressure in the pressure vessel. The pressure in the pressure vessel causes a counter-torque to the motor. The counter-torque is proportional to the pressure, and may be used for estimating the pressure inside the pressure vessel. An estimate of a counter-torque may be calculated on the basis of the monitored electrical quantity or quantities.

The method according to the present disclosure comprises an identification phase and an operational phase. In the identification phase, the compressor may be operated in order to generate a desired pressure to the pressure vessel. At least one electrical quantity (e.g. mechanical power of a motor powering the compressor) at the desired pressure is determined, and a reference level representing a counter-torque caused by the desired pressure may be calculated on the basis of the at least one electrical quantity.

In the operational phase, a present pressure level in the pressure vessel may be determined by monitoring the electrical quantity and calculating a present value for the counter-torque on the basis of the monitored value of the electrical quantity. By controlling the rotational speed of the motor, the present value of the counter-torque may be controlled to the reference value. In this manner, the compressor system can be operated without pressure sensors.

BRIEF DESCRIPTION OF THE DRAWINGS

In the following the invention will be described in greater detail by means of preferred embodiments with reference to the attached drawings, in which.

DETAILED DISCLOSURE

Figure 1:
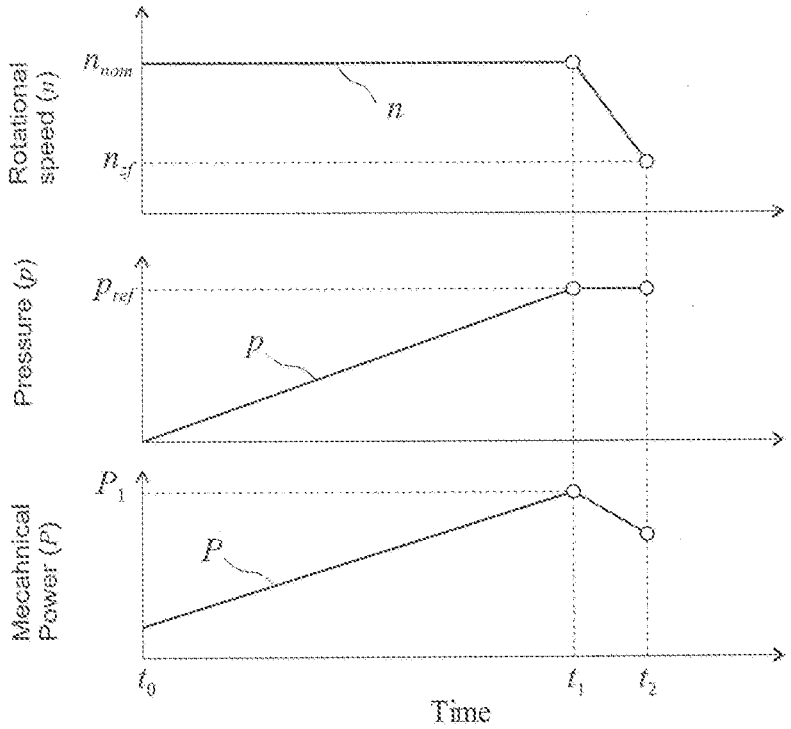
FIG. 1 shows a simplified example of an identification phase according to the present disclosure.

The present disclosure presents a control method for a compressor system that comprises a compressor connected to a pressure vessel and a frequency converter controlling an electric motor of the compressor. The compressor may be a positive displacement compressor (e.g. a screw compressor) or a dynamic compressor (e.g. a centrifugal compressor). During the normal operation of a control method according to the present disclosure, the control goal may be to maintain a pressure inside the pressure vessel at a desired level. In order to achieve this, the present operating state may be estimated and a rotational speed of an electrical motor of the compressor may be controlled on the basis of the estimated operational state. The operational state may represent the pressure in the pressure vessel.

In the method according to the present disclosure, the present operating state may be estimated on the basis of at least one monitored/estimated electrical quantity of the compressor system. Based on the at least one monitored electrical quantity, an estimate of a counter-torque caused by the pressure in the pressure vessel may be calculated. In a compressor system, the distance between the compressor and the pressure vessel can be assumed to be so short that flow-related losses can be neglected. The counter-torque can thus be considered to remain the same regardless of the flow rate and can be used for estimating the pressure inside the pressure level regardless of the rotational speed of the motor of the compressor.

The monitored electrical quantity may be the mechanical power of the electric motor, for example. If the at least one other electrical quantity is the mechanical power, the counter-torque may be simply calculated as the product of the rotational speed and the mechanical power, for example. If the measurements of the electrical quantities are performed on a frequency converter controlling the electric motor, an estimate of the torque may be directly available from the frequency converter. The method according to the present disclosure is not limited to using mechanical power as the monitored electrical quantity. For example, the currents and voltages of the motor be monitored, and the mechanical power may be calculated on the basis of the currents and voltages.

In order to determine the exact relation between the counter-torque and the pressure in a compressor system, the method according to the present disclosure comprises an identification phase before an operational phase. The identification phase comprises an identification run, during which the pressure vessel is pressurized. The compressor may operate at a known rotational speed of the electric motor, for example. The compressor may be operated to increase pressure inside the pressure vessel to a desired level.

Once the desired pressure level has been reached, the value of the rotational speed and the value of at least one other electrical quantity of the electric motor may be determined at the desired pressure level. Based on the rotational speed and the value of the at least one other electrical quantity, a value of a first variable may be calculated. The first variable represents an estimate of the counter-torque of the electric motor caused by the pressure inside the pressure vessel. When the value of the first variable has been calculated, a first reference level may be determined on the basis of the calculated counter-torque. The first reference level represents the counter-torque of the electric motor caused by the desired pressure level.

FIG. 1 shows a simplified example of identification according to the present disclosure. In FIG. 1, a pressure system comprises a pressure vessel which is pressurized with a positive displacement compressor. The identification phase starts when the compressor starts to increase the pressure p inside the pressure vessel at time instant $t_0$. The compressor operates at a constant rotational speed $n_{nom}$ so the pressure increases linearly as a function of time. At instant $t_1$ in FIG. 1, the pressure p reaches a desired level $p_{ref}$. In FIG. 1, when the pressure p inside the pressure vessel reaches the desired level $p_{ref}$, the mechanical power reaches level $P_1$. This level can be stored and used for determining the first reference level for the counter-torque.

During the operational phase, the present values of the at least one electrical quantity and the rotational speed may be determined and a present value of the first variable may be calculated. The value may be calculated on the basis of the present values of the rotational speed and the at least one other electrical quantity. The rotational speed of the electric motor may then be controlled on the basis of the present value of the counter-torque and the first reference level of the counter-torque. The rotational speed may be adjusted such that the calculated present value of the counter-torque follows the first reference level. For example, a PI or a PID controller may be used to control the rotational speed of the compressor so that the pressure inside the pressure vessel stays at a desired level.

The method according to the present disclosure may further comprise a stopping function for the compressor. Once the desired pressure level has been reached during the identification phase, the rotational speed may be reduced until the compressor does not produce flow (i.e. zero-flow conditions are present in the compressor). The value of at least one electrical quantity of the motor may be determined and a value for a second variable may be determined on the basis of the value of at least one electrical quantity. The second variable represents the rotational speed. The second variable may be an estimate of the mechanical power of the electric motor of the compressor, for example. The second variable may also be an estimate of the rotational speed provided by a frequency converter controlling the motor. A second reference level may be determined on the basis of the value of the second variable. The second reference level represents the rotational speed at which the compressor does not produce flow.

In the operational phase, the present value of the second variable may be monitored and, if the monitored value falls below the second reference level, the compressor may be stopped. In this manner, unnecessary operation of the compressor can be avoided, and the energy efficiency of the compressor system can be increased. In FIG. 1, once the desired pressure level has been reached, the rotational speed n starts to ramp down until it reaches a zero-flow rotational speed $n_{nf}$ at which the zero-flow conditions of the pump are detected. The zero flow may be detected with a temporary or permanent flow sensor, for example. The zero-flow rotational speed $n_{nf}$ or the mechanical power at the zero flow rotational speed may be used for determining the second reference level. During normal operation, the rotational speed or the mechanical power may be monitored. If the compressor system is operating at the desired pressure level and the monitored electrical quantity falls below its second reference level, respectively, the compressor may be shut down.

The pressure during the identification phase of the method according to the present disclosure may be monitored by using various approaches. is In some embodiments, temporary or permanent pressure sensors may be used during the identification phase. The pressure in the pressure vessel may be monitored during the identification phase by using a pressure sensor which provides continuous pressure information to the frequency converter, for example.

Figure 2:
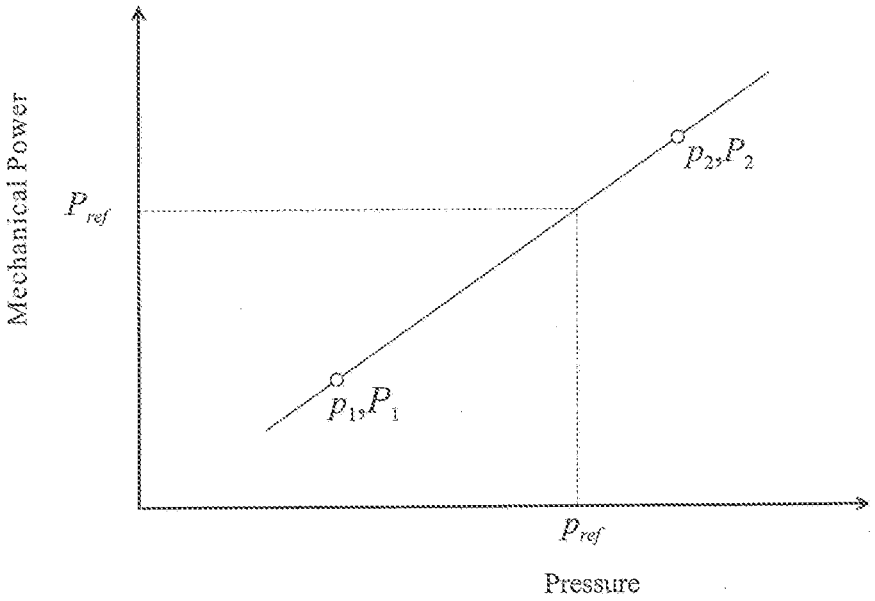
FIG. 2 shows a simplified example of an interpolation function.

In another embodiment, the frequency converter may be provided only with time instant information indicating when predetermined pressure limits have been reached. For example, a minimum and/or maximum pressure valve of the pressure vessel may provide information on the exceeding of a set pressure. By determining the counter-torques at these pressure limits, the counter-torque at a desired pressure level can be determined. If the pressure vessel is pressurized at a known, constant rotational speed during the identification phase, the pressure in the pressure vessel may be assumed to increase linearly during the pressurization, As a result, a linear interpolation function may be generated between the predetermined pressure limits defined by the pressure valves. The interpolation function may represent the counter-torque as a linear function of the pressure inside the pressure vessel, for example. Based on the interpolation function, a counter-torque corresponding to a desired pressure level in the pressure vessel can be determined. FIG. 2 shows a simplified example of an interpolation function determined on the basis of an identification run according to the present disclosure. The identification run is performed in a system comprising a minimum pressure valve and a maximum pressure valve. The valves provide information on the time instant when the respective limit is exceeded. The rotational speed is held at a constant level $n_{nom}$ during the identification run.

FIG. 2 shows two data points ($p_1$,$P_1$ and $p_2$,$P_2$). Each data point represents paired values of the pressure and the mechanical power. The first data point shows the pressure $p_1$ and the mechanical power $P_1$ at the time instant when the minimum pressure limit was exceeded. The second data point shows the pressure $p_2$ and the mechanical power $P_2$ at the time instant when the maximum pressure limit was exceeded. Based on the data points, a linear interpolation function is drawn in FIG. 2. A mechanical power $P_{ref}$ corresponding with the desired pressure level $p_{ref}$ can then be determined from the interpolation function. Since the rotational speed is known, the counter-torque at the desired pressure level can be calculated from the mechanical power $P_{ref}$ and the rotational speed.

The present disclosure also describes a device for implementing the method according to the present disclosure. The method may be implemented on an apparatus comprising a computing device, such as a processor, an FPGA (Field-programmable gate array) or an ASIC (Application Specific Integrated Circuit) and a memory, for example. The method can be implemented on the frequency converter controlling the electric motor of the compressor, for example. This may be desirable when estimates/measurements of the monitored electrical quantities are readily available from the frequency converter.

It will be obvious to a person skilled in the art that the inventive concept can be implemented in various ways. The invention and its embodiments are not limited to the examples described above but may vary within the scope of the claims.

The invention claimed is:

1. A control method for a compressor system comprising a compressor connected to a pressure vessel and a frequency converter controlling a rotational speed of an electric motor of the compressor, wherein the method comprises an identification phase and an operational phase, and wherein the identification phase comprises:

operating the compressor to increase a pressure inside the pressure vessel to a desired pressure level, determining a value of the rotational speed and a value of at least one other electrical quantity of the electric motor at the desired pressure level, calculating a value for a first variable on a basis of the rotational speed and the value of the at least one other electrical quantity, wherein the first variable represents a counter-torque of the electric motor caused by the pressure inside the pressure vessel, determining a first reference level on a basis of the first variable, wherein the first reference level represents a counter-torque caused by the desired pressure level, and wherein the operational phase comprises:

determining present values of the at least one electrical quantity and the rotational speed, calculating a present value of the first variable on a basis of the present values of the rotational speed and the at least one other electrical quantity, controlling the rotational speed of the electric motor using the frequency converter on a basis of the first reference level and the present value of the first variable to maintain the desired pressure level.

2. The control method according to claim 1, wherein the identification phase further comprises reducing the rotational speed until the compressor does not produce flow, determining a value of at least one electrical quantity of the motor, determining a value for a second variable on a basis of the determined value, wherein the second variable represents the rotational speed at the desired pressure level, determining a second reference level on a basis of the value of the second variable, wherein the second reference level represents the rotational speed at which the compressor does not produce flow, and wherein the operational phase comprises:

monitoring the present value of the second variable, and if the present value of the second variable falls below the second reference level, stopping the compressor.

3. The control method according to claim 2, wherein the at least one other electrical quantity is a mechanical power of the electric motor.

4. The control method according to claim 1, wherein the at least one other electrical quantity is a mechanical power of the electric motor.

* * * * *